US007385352B2

(12) United States Patent
Yoo

(10) Patent No.: US 7,385,352 B2
(45) Date of Patent: Jun. 10, 2008

(54) PLASMA DISPLAY PANEL HAVING INITIAL DISCHARGE INDUCING STRING

(75) Inventor: Sung-Hune Yoo, Asan-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 579 days.

(21) Appl. No.: 10/943,968

(22) Filed: Sep. 20, 2004

(65) Prior Publication Data

US 2005/0073477 A1 Apr. 7, 2005

(30) Foreign Application Priority Data

Oct. 1, 2003 (KR) ..... 10-2003-0068334

(51) Int. Cl.
*H01J 17/49* (2006.01)
*H01J 61/00* (2006.01)

(52) U.S. Cl. ..... 313/587; 313/583; 313/586

(58) Field of Classification Search ..... 313/582–587
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Shinoda et al.
5,724,054 A 3/1998 Shinoda (Continued)

FOREIGN PATENT DOCUMENTS

JP 02-148645 6/1990
JP 2845183 10/1998
JP 2917279 4/1999

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Toan Ton
*Assistant Examiner*—Bumsuk Won
(74) *Attorney, Agent, or Firm*—Robert E. Bushnell, Esq.

(57) ABSTRACT

A Plasma Display Panel (PDP) includes: a rear substrate; address electrodes arranged in predetermined intervals over the rear substrate; a rear dielectric layer arranged to cover the address electrodes; barrier ribs arranged to partition discharge spaces on the rear dielectric layer; phosphor layers arranged in the discharge spaces; a front substrate arranged over and facing the rear substrate; and sustain electrodes arranged orthogonal to the address electrodes under the front substrate. A pair of sustain electrodes includes: a common electrode and a scan electrode arranged within a discharge region corresponding to a discharge space to have a discharge gap therebetween; bus electrodes respectively connected to the sustain electrodes; a front dielectric layer arranged to cover the sustain electrodes and the bus electrodes; and at least one initial discharge inducing string each respectively disposed in a discharge region in the front dielectric layer, the at least one initial discharge inducing string comprising a material having a different dielectric constant than that of the front dielectric layer.

27 Claims, 6 Drawing Sheets

U.S. PATENT DOCUMENTS

| | | | | |
|---|---|---|---|---|
| 5,786,794 | A | 7/1998 | Kishi et al. | |
| 5,952,782 | A | 9/1999 | Nanto | |
| RE37,444 | E | 11/2001 | Kanazawa | |
| 6,559,592 | B1 * | 5/2003 | Lee | 313/495 |
| 6,630,916 | B1 | 10/2003 | Shinoda | |
| 6,707,436 | B2 | 3/2004 | Setoguchi et al. | |
| 2002/0084753 | A1 * | 7/2002 | Koshio et al. | 313/587 |

FOREIGN PATENT DOCUMENTS

| | | | |
|---|---|---|---|
| JP | 2001-043804 | | 2/2001 |
| JP | 2001-325888 | | 11/2001 |
| JP | 03-031134 | | 1/2003 |
| KR | 10-2003-0037219 | | 5/2003 |
| KR | 1020030037219 | * | 5/2003 |

OTHER PUBLICATIONS

*Korean Office Action* issued by the Korean Intellectual Property Office in applicant's corresponding Korean Patent Application No. 10-2003-0068334 on Apr. 27, 2005.

* cited by examiner

PLASMA DISPLAY PANEL HAVING INITIAL DISCHARGE INDUCING STRING

CLAIM OF PRIORITY

This application makes reference to, incorporates the same herein, and claims all benefits accruing under 35 U.S.C. § 119 from an application for PLASMA DISPLAY PANEL earlier filed in the Korean Intellectual Property Office on Oct. 1, 2003 and there duly assigned Serial No. 2003-68334.

BACKGROUND OF THE INVENTION

1. Field of the Invention

The present invention relates to a Plasma Display Panel (PDP), and more particularly, to a PDP that facilitates an initial discharge to reduce a sustain voltage and to enhance luminous efficiency.

2. Description of the Related Art

When voltage is applied across two electrodes arranged in a sealed space filled with gas within a PDP, a glow discharge occurs, creating ultra violet rays which excite phosphor layers that are formed in a predetermined pattern, thereby creating an image.

PDPs can be categorized into a Direct Current (DC) type, an Alternating Current (AC) type, and a hybrid type, depending on how they are driven. Depending on the electrode structure, PDPs can also be categorized into PDPs that have two electrodes for performing a discharge operation, and PDPs that have three electrodes. In a DC type PDP, an auxiliary electrode is added to induce an additional discharge. In an AC type PDP, an address electrode is added to increase the address speed by separating a select discharge and a sustain discharge.

In addition, depending on the arrangement of the discharge electrodes, PDPs can be categorized into an opposed discharge type and a surface discharge type. In an opposed discharge type PDP, two sustain electrodes are located on a front substrate and rear substrate, respectively, thereby forming a discharge perpendicular to the panel. In a surface discharge type, two sustain electrodes are located on the same substrate, thereby forming a discharge parallel to the surface of the substrate.

A PDP includes a plurality of address electrodes having a predetermined width and height, the plurality of address electrodes being formed on a rear substrate positioned in a lower portion of the PDP. A rear dielectric layer covers the address electrodes.

Barrier ribs are formed on the rear dielectric layer to partition discharge spaces and to prevent cross-talk from occurring between adjacent discharge spaces. The discharge spaces are filled with a gas and a phosphor layer is formed on the inner side of the barrier ribs.

A front substrate is formed above the rear substrate to face the rear substrate. A pair of sustain electrodes, which include a common electrode and a scan electrode, are arranged under the front substrate. A bus electrode for applying a voltage is formed under each sustain electrode. A front dielectric layer covers the sustain electrodes and the bus electrodes, and a protective layer is further arranged under the front dielectric layer.

In the PDP having the above-described structure, the sustain electrode is formed of a transparent Indium Tin Oxide (ITO) film. Since the ITO film can cause a voltage drop due to poor conductivity, the sustain electrodes are connected to the bus electrodes. The bus electrodes are formed of metal that has a good conductivity.

A black stripe is additionally provided in an interfacial region between the discharge spaces to improve contrast to significantly affect the PDP. A PDP disclosed in Japanese Laid-Open Patent Publication No. 2003-31134 has such a black stripe.

However, since the black stripe is arranged in the interfacial region between the discharge spaces, the bus electrodes are arranged in a discharge region corresponding to the discharge spaces. Consequently, the bus electrodes, formed of an opaque metal, can reduce an aperture ratio of the PDP and block some of the visible light emitted from the discharge spaces, thereby reducing the luminance of the PDP.

To solve these problems, the PDP can be designed such that the bus electrode is placed in a non-discharge region, e.g., on the barrier rib. Thus, the aperture ratio of the PDP can be improved so as not to block visible light and reduce luminance.

However, if the bus electrode is formed on the barrier rib, the width of the sustain electrode increases so that an electric field formed in the discharge space is not sufficiently reinforced and concentrated. Thus, the luminous efficiency of the PDP is reduced.

SUMMARY OF THE INVENTION

The present invention provides a Plasma Display Panel (PDP), in which initial discharge inducing strings are additionally formed in discharge regions so that a sustain voltage is reduced and the luminous efficiency is enhanced.

According to an aspect of the present invention, a PDP is provided comprising: a rear substrate; address electrodes arranged at predetermined intervals over the rear substrate; a rear dielectric layer arranged to cover the address electrodes; barrier ribs arranged to partition discharge spaces on the rear dielectric layer; phosphor layers formed in the discharge spaces; a front substrate arranged over the rear substrate and facing the rear substrate; sustain electrodes arranged orthogonal to the address electrodes and under the front substrate, a pair of sustain electrodes including a common electrode and a scan electrode arranged within a discharge region corresponding to a discharge space so as to have a discharge gap therebetween; bus electrodes respectively connected to the sustain electrodes; a front dielectric layer arranged to cover the sustain electrodes and the bus electrodes; and at least one initial discharge inducing string, each string respectively arranged in discharge regions in the front dielectric layer, the at least one initial discharge inducing string comprising a material having a different dielectric constant than that of the front dielectric layer.

According to another aspect of the present invention, a PDP is provided comprising: a rear substrate; address electrodes arranged at over the rear substrate; a rear dielectric layer arranged to cover the address electrodes; barrier ribs arranged to partition discharge spaces on the rear dielectric layer; a front substrate arranged over the rear substrate and facing the rear substrate; sustain electrodes arranged orthogonal to the address electrodes and under the front substrate; a front dielectric layer arranged to cover the sustain electrodes; and at least one initial discharge inducing string, each string respectively arranged in discharge spaces in the front dielectric layer.

The at least one initial discharge inducing string preferably comprises a material having a different dielectric constant than that of the front dielectric layer.

The at least one initial discharge inducing string comprises a ferroelectric substance having a higher dielectric constant than that of the front dielectric layer.

The at least one initial discharge inducing string preferably comprises a substance selected from the group consisting of BTO, BST, PTO, and PZT.

The dielectric constant of each of the at least one initial discharge inducing string is preferably greater than 100.

Each of the at least one initial discharge inducing string is preferably formed by a process selected from the group consisting of chemical vapor deposition, RF sputtering, laser ablation, and a sol-gel method.

Each of the at least one initial discharge inducing string is preferably respectively connected to the sustain electrodes.

Each of the at least one initial discharge inducing string respectively preferably comprises a stripe parallel to the sustain electrodes.

Each of the at least one initial discharge inducing string preferably comprises separated portions respectively arranged in the discharge spaces.

Each of the at least one initial discharge inducing strings is preferably respectively separated a predetermined distance from the sustain electrodes.

The barrier ribs preferably comprise first barrier ribs arranged parallel to and alternating with the address electrodes and second barrier ribs extending from the sides of the first barrier ribs.

The sustain electrodes respectively preferably comprise protruding portions respectively formed in the discharge regions and cut portions alternating with the protruding portions and formed by cutting portions corresponding respectively to the first barrier ribs.

The plasma display panel further preferably comprises a protective layer arranged under the front dielectric layer.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION

Figure 1:
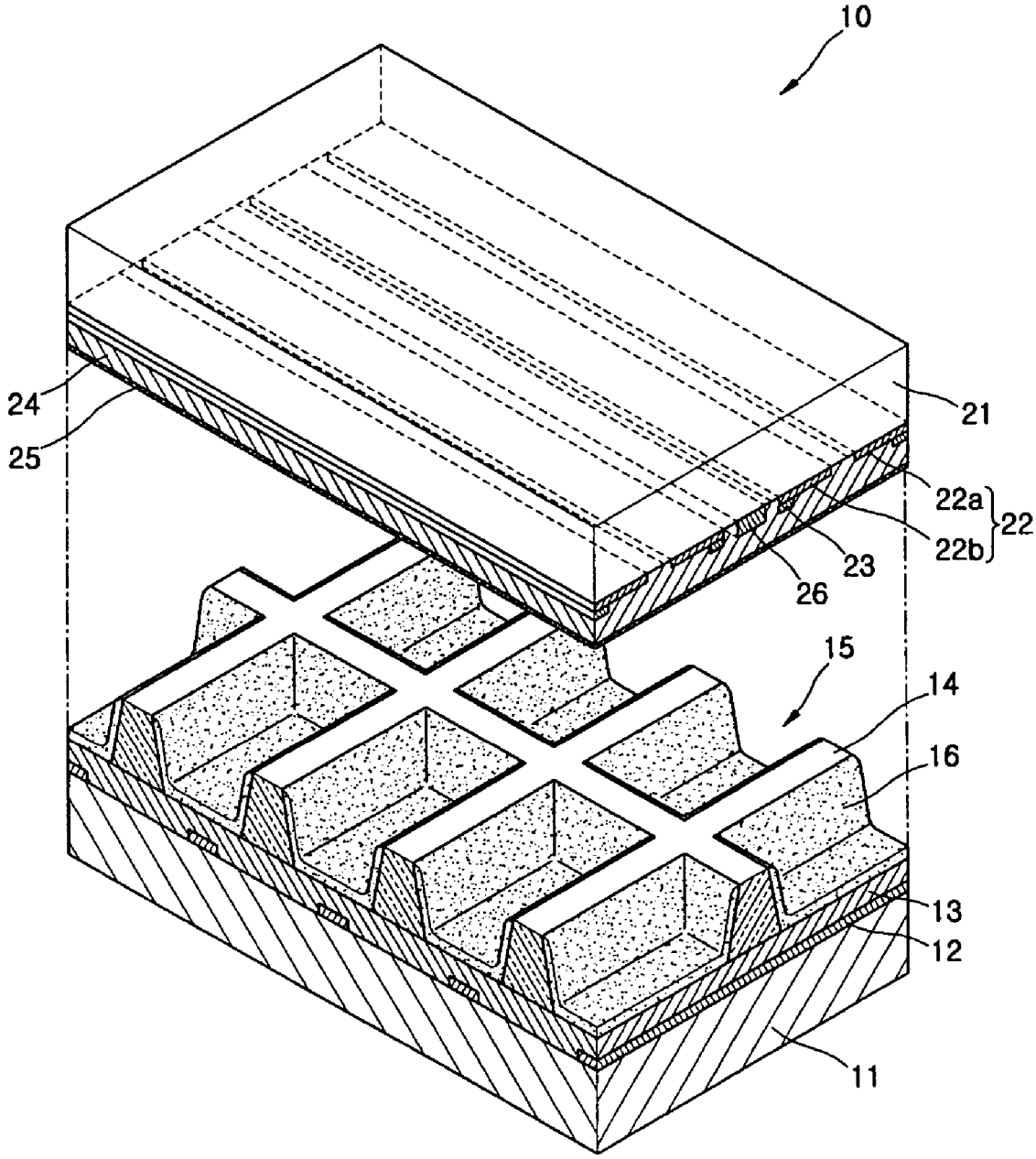
FIG. 1 is an exploded perspective view of a Plasma Display Panel (PDP)

Referring to FIG. 1, a PDP 10 includes a plurality of address electrodes 12 having a predetermined width and height, the plurality of address electrodes 12 being formed on a rear substrate 11 positioned in a lower portion of the PDP 10. A rear dielectric layer 13 covers the address electrodes 12.

Barrier ribs 14 are formed on the rear dielectric layer 13 to partition discharge spaces 15 and to prevent cross-talk from occurring between adjacent discharge spaces 15. The discharge spaces 15 are filled with a gas and a phosphor layer 16 is formed on the inner side of the barrier ribs 14.

A front substrate 21 is formed above the rear substrate 11 to face the rear substrate 11. A pair of sustain electrodes 22, which include a common electrode 22*a* and a scan electrode 22*b*, are arranged under the front substrate 21. A bus electrode 23 for applying a voltage is formed under each sustain electrode 22. A front dielectric layer 24 covers the sustain electrodes 22 and the bus electrodes 23, and a protective layer 25 is further arranged under the front dielectric layer 24.

In the PDP 10 that has the above-described structure, the sustain electrode 22 is formed of a transparent Indium Tin Oxide (ITO) film. Since the ITO film can cause a voltage drop due to poor conductivity, the sustain electrodes 22 are connected to the bus electrodes 23. The bus electrodes 23 are formed of metal that has a good conductivity.

As shown in FIG. 1, a black stripe 26 is additionally provided in an interfacial region between the discharge spaces 15 to improve contrast to significantly affect the PDP 10. A PDP disclosed in Japanese Laid-Open Patent Publication No. 2003-31134 has such a black stripe.

However, since the black stripe 26 is arranged in the interfacial region between the discharge spaces 15, the bus electrodes 23 are arranged in a discharge region corresponding to the discharge spaces 15. Consequently, the bus electrodes 23, formed of opaque metal, can reduce an aperture ratio of the PDP 10 and block some of the visible light emitted from the discharge spaces 15, thereby reducing the luminance of the PDP 10.

To solve these problems, the PDP 10 can be designed such that the bus electrode 23 is arranged in a non-discharge region, e.g., on the barrier rib 14. Thus, the aperture ratio of the PDP 10 can be improved so as not to block visible light and reduce luminance.

However, if the bus electrode 23 is formed on the barrier rib 14, the width of the sustain electrode 22 increases so that an electric field formed in the discharge space 15 is not sufficiently reinforced and concentrated. Thus, the luminous efficiency of the PDP 10 can be reduced.

Figure 2:
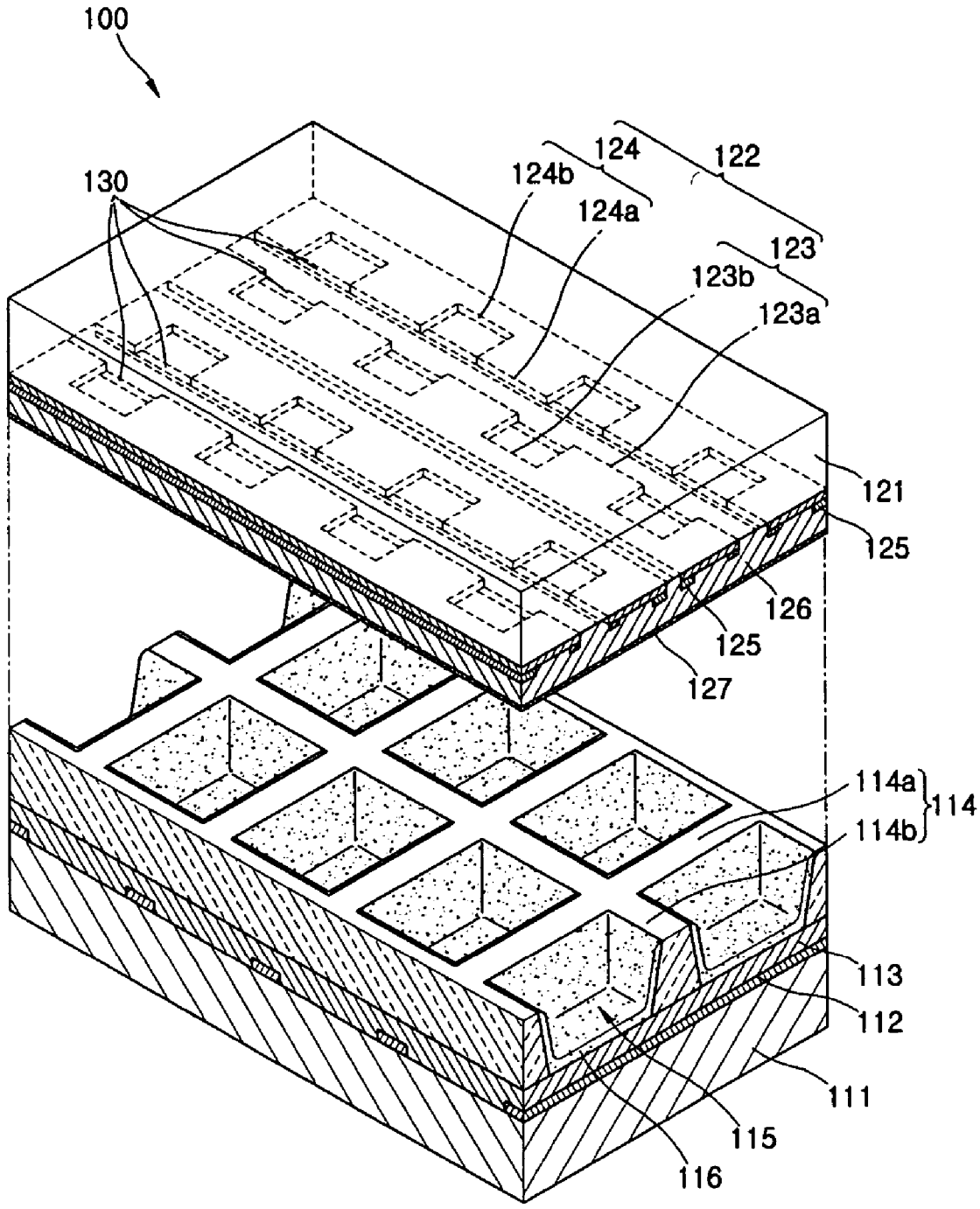
FIG. 2 is an exploded perspective view of a PDP according to an embodiment of the present invention.
Figure 3:
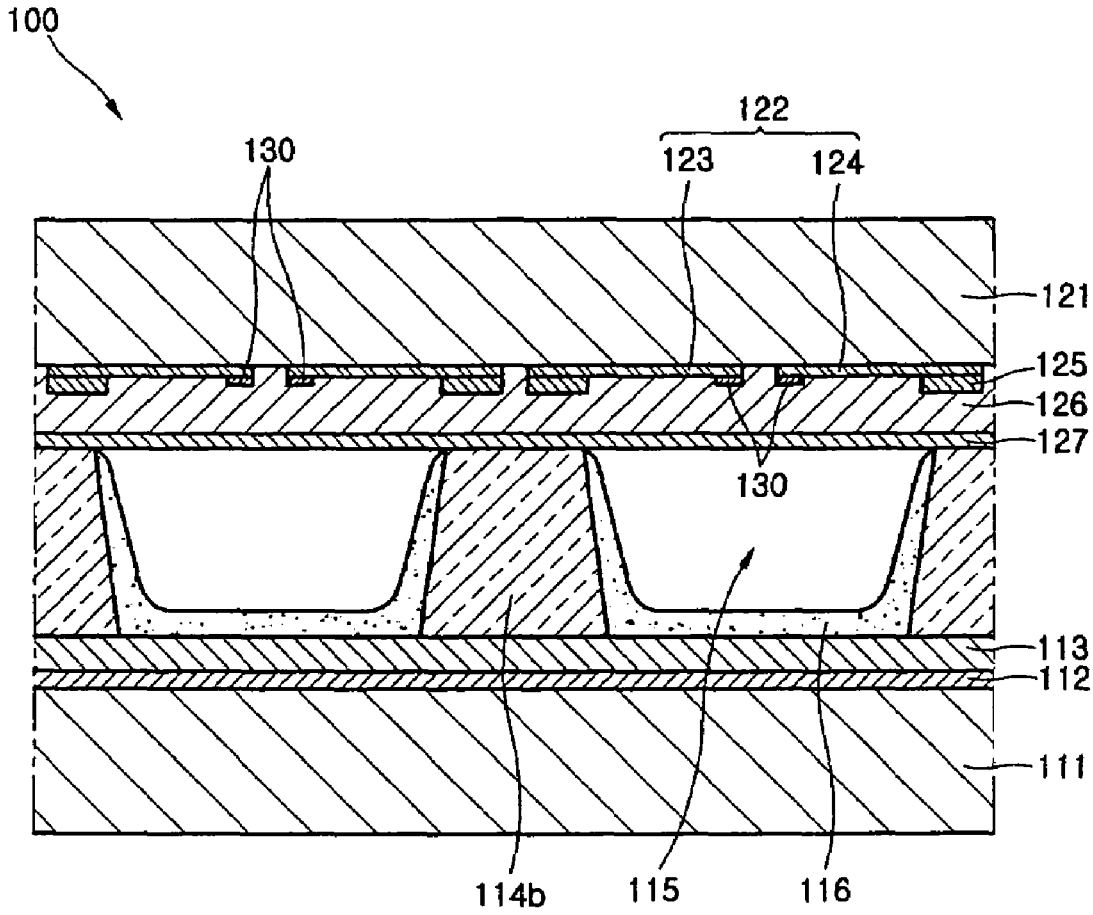
FIG. 3 is a cross-sectional view of the PDP of FIG. 2.

A plasma display panel (PDP) 100 according to an embodiment of the present invention is shown in FIGS. 2 and 3. The PDP 100 includes a front substrate 121, formed of glass or another transparent material, and a rear substrate 111 arranged below and facing the front substrate 121.

A plurality of address electrodes 112 are formed in stripes at predetermined intervals over the rear substrate 111. A rear electric layer 113 covers the address electrodes 112.

Barrier ribs 114 are formed on the rear dielectric layer 113 and partition discharge spaces 115 between the rear substrate 111 and the front substrate 121.

The barrier ribs 114 include first barrier ribs 114*a* having a predetermined height and width and arranged at predetermined intervals, and second barrier ribs 114*b* respectively extending from the side of the first barrier ribs 114*a* so as to be orthogonal to the first barrier ribs 114*a*. The first barrier ribs 114*a* are formed parallel to and alternating with the address electrodes 112.

The first and second barrier ribs 114*a* and 114*b* partition discharge spaces 115 into a matrix form. The second barrier ribs 114*a* are formed of substantially the same material as the first barrier ribs 114*b* and can be integrally formed with the first barrier ribs 114*b*. The form of the barrier ribs 114 is not limited to what is shown in the drawing figures. Any form of barrier rib that can partition the discharge cells into a pixel alignment pattern can be employed. For example, the barrier ribs can include only the first barrier ribs, without the second barrier ribs, and partition discharge spaces in stripes.

Phosphor layers 116 are respectively formed in the discharge spaces 115 that are partitioned by the foregoing barrier ribs 114. To be more specific, the phosphor layers 116 are each formed to cover the inner side surfaces of the barrier ribs 114 and the top surface of the rear dielectric layer 113. The phosphor layers 116 are made of red, green, and blue phosphors and can be divided into red phosphor layers, green phosphor layers, and blue phosphor layers, depending on the color of the phosphor. The red, green, and blue phosphor layers are arranged adjacent to one another and form a pixel.

The front substrate 121 is arranged above and facing the rear substrate 111, and sustain electrodes 122 and bus electrodes 125 are arranged under the front substrate 121.

The sustain electrodes 122 are formed of a transparent conductive material, for example, an ITO film. The sustain electrodes 122 include common electrodes 123 and scan electrodes 124.

The common electrodes 123 include protruding portions 123*a*, protruding in the discharge regions corresponding to the discharge spaces 115, and cut portions 123*b*, disposed so as to alternate with the protruding portions 123*a*, the cut portions 123*b* being formed by cutting portions corresponding to the first barrier ribs 114*a*. Likewise, the scan electrodes 124 include protruding portions 124*a*, protruding in the discharge regions corresponding to the discharge spaces 115, and cut portions 124*b*, disposed so as to alternate with the protruding portions 124*a*, the cut portions 124*b* being formed by cutting portions corresponding to the first barrier ribs 114*a*. The structure of the sustain electrodes 122 is not limited to the foregoing, but can have various shapes, for example, a stripe shape.

The common electrodes 123 and the scan electrodes 124 form pairs and alternate in their arrangement. In addition, the common electrodes 123 and the scan electrodes 124 are arranged such that predetermined discharge gaps are formed between the protruding portions 123*a* of the common electrodes 123 and the protruding portions 124*a* of the scan electrodes 124 facing each other.

One side of the bottom surface of each sustain electrode 122 has a predetermined width, and the bus electrodes 125 are formed parallel to the sustain electrodes 122. The bus electrodes 125 can be formed of metal that has a good conductivity, such as a silver paste.

Beneath the front substrate 121, the sustain electrodes 122 and the bus electrodes 125 are covered by a front dielectric layer 126. A protective layer 127 formed of, for example, MgO, can be additionally formed under the front dielectric layer 126.

In the present invention, the bus electrodes 125 are disposed in place of black stripes in interfacial regions between the discharge spaces (i.e., non-discharge regions), to improve the contrast characteristics of PDPs.

In other words, a pair of bus electrodes 125 are disposed adjacent to each other on both sides of a single second barrier rib 114*b*. More preferably, the pair of bus electrodes 125 are disposed on the second barrier rib 114*b* (i.e., on the non-discharge region). Thus, a phenomenon in which a discharge space is shielded by a bus electrode and thus an aperture ratio is reduced can be prevented.

As shown in FIG. 2, initial discharge inducing strings 130 of a predetermined width are arranged at an end portion of each of the common electrodes 123 and the scan electrodes 124 forming the discharge gaps within the front dielectric layer 126. The initial discharge inductive strings 130 are respectively connected to the bottom surfaces of the common electrodes 123 and the scan electrodes 124, and are consecutively formed in stripes to respectively connect all of the protruding portions 123*a* and 124*a*.

Figure 4:
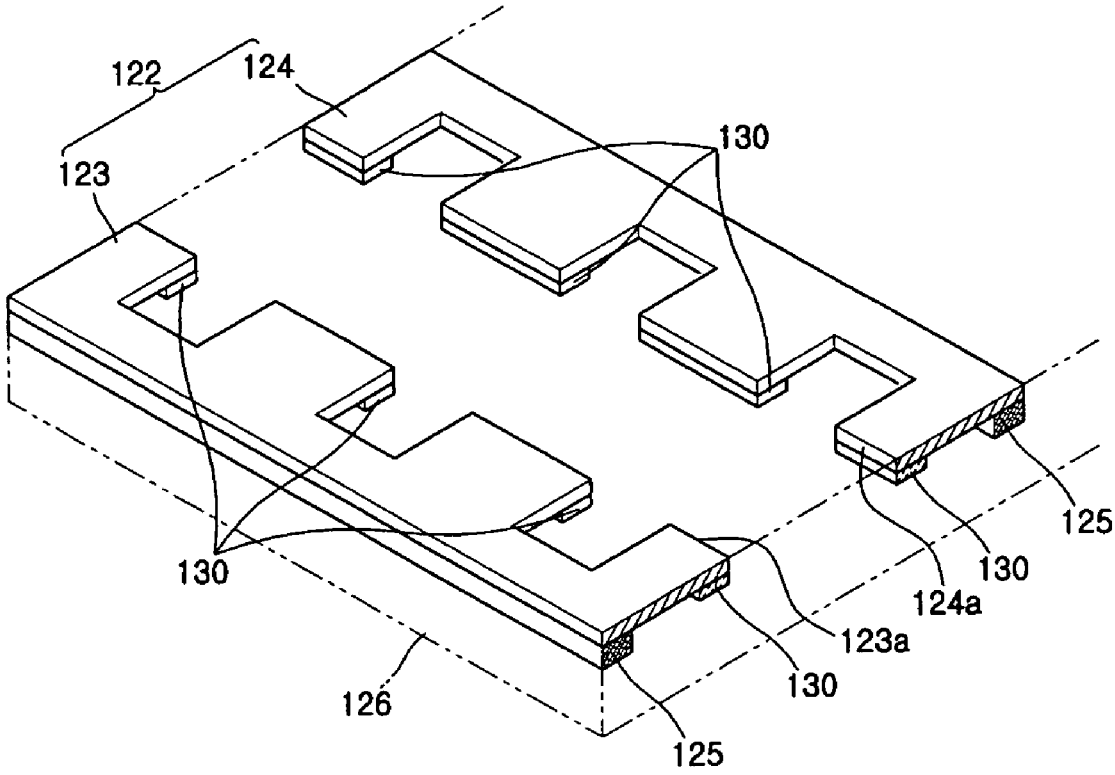
FIGS. 4 through 6 are exploded perspective views of different examples of the initial discharge inducing strings of FIG. 2.

However, the structure of the initial discharge inducing strings 130 is not limited to the foregoing, but can be realized in various forms. FIG. 4 shows a modified example in which initial discharge inducing strings 130 are separated from one another to correspond to protruding portions 123*a* of common electrodes 123 and are discontinuously arranged on the bottom surfaces of the protruding portions 123*a*. Similarly, initial discharge inducing strings 130 also can be separated from one another to correspond to protruding portions 124*a* of scan electrodes 124 and are discontinuously arranged on the bottom surfaces of the protruding portions 124*a*.

Figure 5:
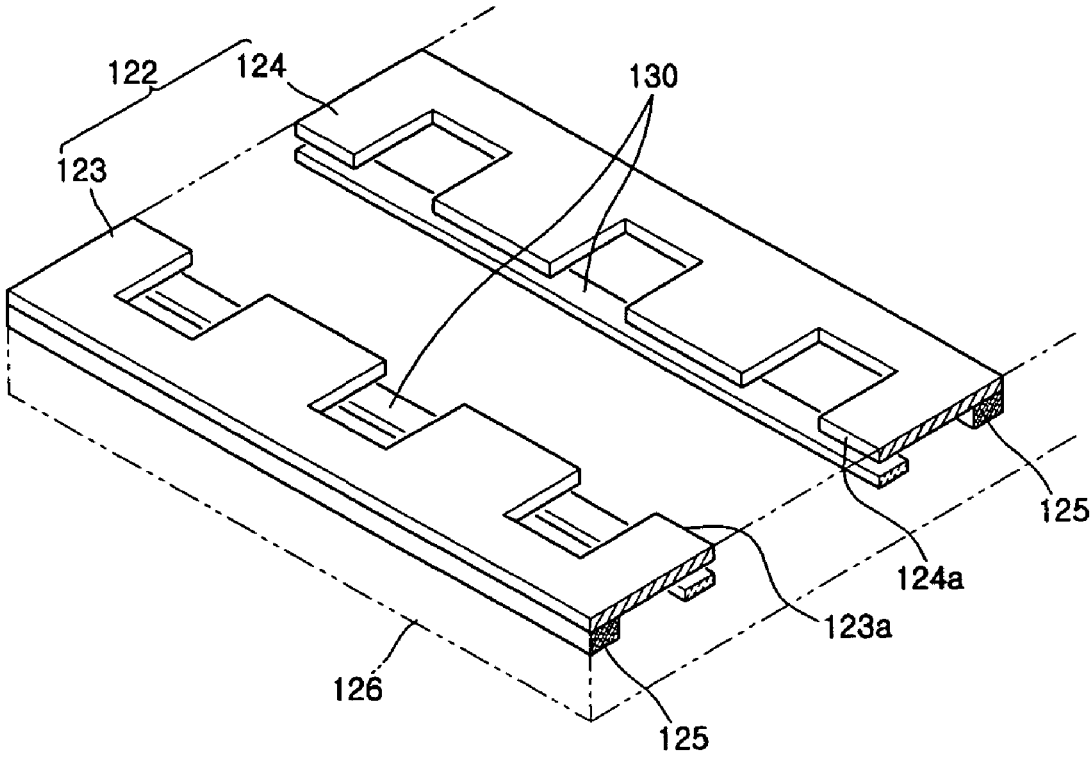

Alternatively, as shown in FIG. 5, initial discharge inducing strings 130 can be spaced a predetermined distance apart from end portions of sustain electrodes 122 forming discharge gaps and formed of a predetermined width within the front dielectric layer 126. The initial discharge inducing strings 130 can be consecutively arranged in stripes and spaced a predetermined distance apart from protruding portions 123*a* of common electrodes 123. Likewise, initial discharge inducing strings 130 also can be consecutively arranged to correspond to protruding portions 124*a* of scan electrodes 124.

Figure 6:
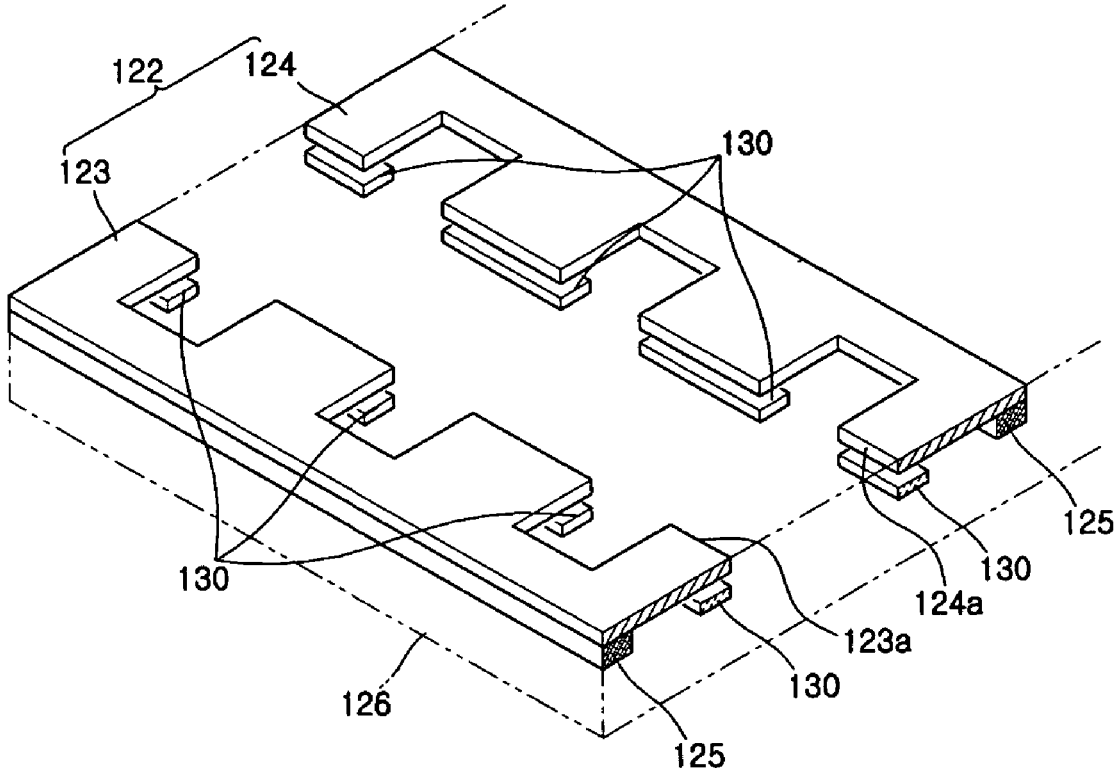

FIG. 6 shows yet another example in which initial discharge inducing strings 130 are separated from one another to correspond to protruding portions 123*a* of common electrodes 123 forming discharge gaps and are discontinuously arranged a predetermined distance apart from the bottom surfaces of the protruding portions 123*a*. Likewise, initial discharge inducing strings 130 can be separated from one another and discontinuously arranged to correspond to protruding portions 124*a* of scan electrodes 124.

The structure of the initial discharge inducing strings 130 is not limited to the foregoing embodiments. Any form of initial discharge inducing strings that are disposed in discharge regions within the front dielectric layer 126 can be employed. Also, although the drawing figures show the initial discharge inducing strings 130 formed on all of the common electrodes 123 and the scan electrodes 124 of the sustain electrodes 122, they can be formed to correspond to any number thereof.

The initial discharge inducing strings 130, which are covered in the front of the dielectric layer 126, are formed of a material that has a different dielectric constant than that of the front dielectric layer 126. It is preferable that the initial discharge inducing strings 130 have a higher dielectric constant than the front dielectric layer 126. Typically, the dielectric constant of the front dielectric layer 126 is about 13, but it is preferable that the dielectric constant of the initial discharge inducing strings 130 is greater than 100.

The initial discharge inducing strings 130 can be formed of one a ferroelectric substance, such as BTO($BaTiO_3$), BST($(Ba,Sr)TiO_3$), PTO($PbTiO_3$), or PZT($Pb(Zr,Ti)O_3$). In addition, the initial discharge inducing strings 130 are each preferably formed of a thin film using a Chemical Vapor Deposition (CVD), Radio-Frequency (RF) sputtering, laser ablation, or a sol-gel method.

Similar to the bus electrodes 125, the initial discharge inducing strings 130 are formed of an opaque material, thereby reducing an aperture ratio. However, since the bus electrodes 125 are disposed on the second barrier ribs 114*b*, they can compensate for the reduction of the aperture ratio caused by the initial discharge inducing strings 130. Accordingly, the PDP 100 can have an aperture ratio equal to or greater than the conventional PDP by controlling the width of the initial discharge inducing strings 130.

As described above, the ferroelectric initial discharge inducing strings 130 are further provided on portions of the sustain electrodes 122 in the discharge spaces 115. Thus, even if the width of the sustain electrodes 122 forming predetermined discharge gaps increases due to the bus electrodes 125 disposed on the second barrier ribs, an electric field formed in the discharge space 115 can be sufficiently reinforced and concentrated, thereby facilitating initial discharge. Also, a sustain voltage is reduced and the luminous efficiency of the PDP 100 is enhanced.

The following is a brief description of the operation of the PDP 100 that has the above-described structure.

At the outset, if an address voltage is applied between the address electrode 112 and the scan electrode 124 of the sustain electrode 122, a discharge occurs, and wall charges are formed under the addressed front dielectric layer 126. In such a circumstance, a discharge is maintained by applying a predetermined voltage between the common electrode 123 and the sustain electrode 124.

Since the ferroelectric initial discharge inducing strings 130 are further provided on portions of the sustain electrodes 122 in the discharge spaces 115, a great number of wall charges are accumulated on the bottom surface of the front dielectric layer 126, thereby facilitating an initial discharge. Also, even if a low sustain voltage is applied to the common electrode 123 and the sustain electrode 124, a discharge can be reliably maintained.

When the discharge is maintained, electric charges are created and collide with gas, thereby forming a plasma and creating ultraviolet rays. The ultraviolet rays excite and light-up the fluorescent substance of the phosphor layer 116 to thereby form a picture image.

As explained thus far, in the PDP of the present invention, initial discharge inducing strings are further provided on portions of the sustain electrodes in discharge regions thereof, thereby facilitating an initial discharge. Furthermore, since a sustain voltage applied to the common electrodes and scan electrodes to maintain a discharge can be sufficiently reduced, the luminous efficiency of the PDP can be enhanced.

While the present invention has been particularly shown and described with reference to exemplary embodiments thereof, it will be understood by those of ordinary skill in the art that various changes in form and details can be made therein without departing from the spirit and scope of the present invention as recited by the following claims.

What is claimed is:

1. A plasma display panel comprising:

a rear substrate;

address electrodes arranged at predetermined intervals over the rear substrate;

a rear dielectric layer arranged to cover the address electrodes;

barrier ribs arranged to partition discharge spaces on the rear dielectric layer;

phosphor layers arranged in the discharge spaces;

a front substrate arranged over the rear substrate and facing the rear substrate;

sustain electrodes arranged orthogonal to the address electrodes and under the front substrate, a pair of the sustain electrodes including a common electrode and a scan electrode arranged within a discharge region corresponding to a discharge space so as to have a discharge gap therebetween;

bus electrodes respectively connected to the sustain electrodes;

a front dielectric layer arranged to cover the sustain electrodes and the bus electrodes; and at least one initial discharge inducing string, each string respectively arranged in discharge regions in the front dielectric layer, the at least one initial discharge inducing string comprising a dielectric material having a different dielectric constant from that of the front dielectric layer.

2. The plasma display panel of claim 1, wherein the at least one initial discharge inducing string comprises a ferroelectric substance having a higher dielectric constant than that of the front dielectric layer.

3. The plasma display panel of claim 2, wherein the at least one initial discharge inducing string comprises a substance selected from the group consisting of BTO, BST, PTO, and PZT.

4. The plasma display panel of claim 1, wherein each of the at least one initial discharge inducing string is respectively connected to the sustain electrodes.

5. The plasma display panel of claim 4, wherein each of the at least one initial discharge inducing string respectively comprises a stripe parallel to the sustain electrodes.

6. The plasma display panel of claim 4, wherein each of the at least one initial discharge inducing string comprises separated portions respectively arranged in the discharge regions.

7. The plasma display panel of claim 1, wherein each of the at least one initial discharge inducing strings is respectively separated a predetermined distance from the sustain electrodes.

8. The plasma display panel of claim 7, wherein each of the at least one initial discharge inducing strings respectively comprises a stripe parallel to the sustain electrodes.

9. The plasma display panel of claim 7, wherein each of the at least one initial discharge inducing string comprises separated portions respectively arranged in the discharge regions.

10. The plasma display panel of claim 1, wherein the barrier ribs comprise first barrier ribs arranged parallel to and alternating with the address electrodes and second barrier ribs extending from the sides of the first barrier ribs, and wherein the bus electrodes are respectively arranged on the second barrier ribs.

11. The plasma display panel of claim 10, wherein the sustain electrodes respectively comprise protruding portions respectively formed in the discharge regions and cutout portions alternating with the protruding portions, in the same place as the protruding portions, and respectively to the first barrier ribs.

12. The plasma display panel of claim 1, further comprising a protective layer arranged under the front dielectric layer.

13. A plasma display panel comprising:

a rear substrate;

address electrodes arranged at over the rear substrate;

a rear dielectric layer arranged to cover the address electrodes;

barrier ribs arranged to partition discharge spaces on the rear dielectric layer;

a front substrate arranged over the rear substrate and facing the rear substrate;

sustain electrodes arranged orthogonal to the address electrodes and under the front substrate;

a front dielectric layer arranged to cover the sustain electrodes; and at least one initial discharge inducing string of a dielectric material, each string respectively arranged in discharge spaces in the front dielectric layer.

14. The plasma display panel of claim 13, wherein the at least one initial discharge inducing string comprises a dielectric material having a different dielectric constant from that of the front dielectric layer.

15. The plasma display panel of claim 13, wherein the at least one initial discharge inducing string comprises a ferroelectric substance having a higher dielectric constant than that of the front dielectric layer.

16. The plasma display panel of claim 13, wherein the at least one initial discharge inducing string comprises a substance selected from the group consisting of BTO, BST, PTO, and PZT.

17. The plasma display panel of claim 13, wherein the dielectric constant of each of the at least one initial discharge inducing string is greater than 100.

18. The plasma display panel of claim 13, wherein each of the at least one initial discharge inducing string is formed by a process selected from the group consisting of chemical vapor deposition, RF sputtering, laser ablation, and a sol-gel method.

19. The plasma display panel of claim 13, wherein each of the at least one initial discharge inducing string is respectively connected to the sustain electrodes.

20. The plasma display panel of claim 19, wherein each of the at least one initial discharge inducing string comprises separated portions respectively arranged in the discharge spaces.

21. The plasma display panel of claim 13, wherein each of the at least one initial discharge inducing string respectively comprises a stripe parallel to the sustain electrodes.

22. The plasma display panel of claim 13, wherein each of the at least one initial discharge inducing strings is respectively separated a predetermined distance from the sustain electrodes.

23. The plasma display panel of claim 22, wherein each of the at least one initial discharge inducing strings respectively comprises a stripe parallel to the sustain electrodes.

24. The plasma display panel of claim 22, wherein each of the at least one initial discharge inducing string comprises separated portions respectively arranged in the discharge regions.

25. The plasma display panel of claim 13, wherein the barrier ribs comprise first barrier ribs arranged parallel to and alternating with the address electrodes and second barrier ribs extending from the sides of the first barrier ribs.

26. The plasma display panel of claim 25, wherein the sustain electrodes respectively comprise protruding portions respectively formed in the discharge regions and cutout portions alternating with the protruding portions, and in the same plane as the protruding portions, and respectively to the first barrier ribs.

27. The plasma display panel of claim 13, further comprising a protective layer arranged under the front dielectric layer.

* * * * *